United States Patent [19]

Treuhaft et al.

[11] 4,406,500

[45] Sep. 27, 1983

[54] CUTTING ASSEMBLY INCLUDING EXPANDING WALL SEGMENTS OF AUGER

[75] Inventors: Martin B. Treuhaft; Michael S. Oser, both of San Antonio, Tex.

[73] Assignee: The United States of America as represented by the U.S. Department of Energy, Washington, D.C.

[21] Appl. No.: 277,436

[22] Filed: Jun. 25, 1981

[51] Int. Cl.[3] ..... E21B 7/28

[52] U.S. Cl. ..... 299/80; 175/267; 175/285

[58] Field of Search ..... 299/80; 175/267, 285

[56] References Cited

U.S. PATENT DOCUMENTS 3,642,325 2/1972 Mulvaney ..... 299/80 X
4,159,149 6/1979 Castanoli ..... 299/80

FOREIGN PATENT DOCUMENTS 193407 3/1967 U.S.S.R. ..... 299/80
308187 8/1971 U.S.S.R. ..... 299/80
314891 9/1971 U.S.S.R. ..... 299/80
613099 6/1978 U.S.S.R. ..... 299/80

*Primary Examiner*—Ernest R. Purser
*Attorney, Agent, or Firm*—Edwin D. Grant; Stephen D. Hamel; Richard G. Besha

[57] ABSTRACT

A mining auger comprises a cutting head carried at one end of a tubular shaft and a plurality of wall segments which in a first position thereof are disposed side by side around said shaft and in a second position thereof are disposed oblique to said shaft. A vane projects outwardly from each wall segment. When the wall segments are in their first position, the vanes together form a substantially continuous helical wall. A cutter is mounted on the peripheral edge of each of the vanes. When the wall segments are in their second position, the cutters on the vanes are disposed radially outward from the perimeter of the cutting head.

6 Claims, 10 Drawing Figures

CUTTING ASSEMBLY INCLUDING EXPANDING WALL SEGMENTS OF AUGER

This invention resulted from a contract with the United States Department of Energy and relates to a cutting assembly. More particularly, the invention provides an improved drilling tool useful for mining material such as coal.

BACKGROUND OF THE INVENTION

It is often expedient to remove coal from a seam deposit by means of an auger-type cutting assembly comprising a rotatable shaft having a cutting head at one end thereof and a helical vane (or flight) extending along the shaft for conveying coal cut by the cutting head. Holes cut in a vertical mine wall by this type of drilling tool are spaced apart to leave support webs in the mined coal seam. Consequently, a considerable amount of coal is left between holes drilled in this manner. The amount of coal recoverable by a mining operation of the described type could be increased if drill holes could be enlarged at a predetermined distance from a vertical mine facing, thus forming a strong support wall extending for a short distance from the latter and decreasing the web thickness between holes behind this support wall.

SUMMARY OF THE INVENTION

It is an object of this invention to provide a cutting assembly that can recover a higher percentage of coal from a seam deposit than is possible with conventional equipment.

Another object of the invention is to provide a mining auger that can be expanded and contracted to different diameters, whereby the diameter of holes drilled in a vertical mine facing can be increased at any selected distance from the facing.

These objects and other advantages of the invention are attained by pivotally mounting segments of an auger conveyor behind the cutting head of a drilling assembly, the pivotal auger segments together forming the forward portion of the auger conveyor and carrying cutters so that a hole cut by the drilling assembly can be enlarged by pivoting the auger segments outwardly relative to the axis of the hole when the drilling assembly is moved out of the hole. The auger segments are returned to their initial position before they reach the outer end of the drilled hole, and then the auger segments and the cutting head are withdrawn through the portion of the hole which has not been enlarged.

DESCRIPTION OF PREFERRED EMBODIMENTS OF THE INVENTION

Figure 1:
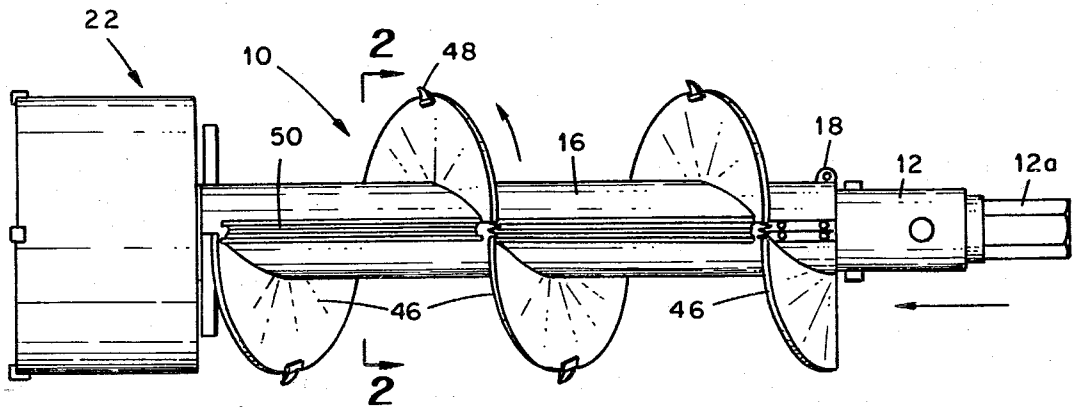
FIG. 1 is a side elevation of components of a preferred embodiment of the invention, illustrating auger conveying and cutting segments thereof in a retracted position.

In FIG. 1, reference number 10 generally designates a cutting assembly comprising a tubular support shaft 12 one end of which is provided with a connector element **12*a* joinable with a conventional auger-type conveyor element (not illustrated) to increase the length of a hole cut by the assembly. Shaft 12, or an extension auger element connected thereto, is attached during a drilling operation to conventional mining apparatus operable to rotate the shaft in opposite directions and also to move it along its longitudinal axis in opposite directions. Three support lugs 14 (see FIG. 5, wherein two of these lugs are illustrated) are fixedly attached to shaft 12 and project radially outward therefrom, these lugs being equidistant from the free end of the shaft and equidistant from one another circumferentially of the shaft. Three wall segments 16 having an arcuate profile in a plane perpendicular to the longitudinal axis of shaft 12 (see FIG. 2) extend forwardly from lugs 14 toward the free end of shaft 12, each of these wall segments having attached to its outer surface a mounting lug 18 which is connected to a respective one of the lugs 14 by a pivot pin 20. The longitudinal axes of pins 20 lie in a plane perpendicular to the longitudinal axis of shaft 12, and the longitudinal axis of each pin is perpendicular to a plane which includes the longitudinal axis of the shaft. Mounted on the free end of shaft 12 by means that will be described in detail hereinafter is a conventional cutting head, this means being generally designated by reference number 22 and comprising outer and inner cutter-carrying rings designated 24, 26 respectively (see FIG. 9), arms 28 extending radially between and connected to these rings, cutters 30, 32 (see FIG. 3) respectively mounted on the forward edges of the rings and spaced apart from one another circumferentially thereof, a kerf breaker 34, and a core breaker 36. The free ends of wall segments 16 terminate close to the back side of cutting head 22, and a latch finger 38 (see FIG. 9) is fixedly attached to each wall segment and projects forwardly from the front edge thereof through a guide means consisting of two guide fingers 40, 42 fixedly attached to and extending radially outward from shaft 12. The outer ends of each associated pair of guide fingers 40, 42 are integrally joined by a cross bar 44**.

A plurality of vanes 46 are respectively mounted on wall segments 16 and project radially outward therefrom. For a reason that will become apparent hereinafter, when wall segments 16 are in a first position illustrated in FIG. 1, their confronting side edges (i.e., the edges extending longitudinally of shaft 12) and the radially extending edges of vanes 46 are spaced apart. Vanes 46 are disposed oblique to the side edges of wall segments 16 and their curvature and locations on the wall segments are such that when the wall segments are in the position illustrated in FIG. 1, the vanes together form a substantially continuous helical wall (or flight) which extends about the tube-shaped shell formed around shaft 12 by the wall segments. Cutters 48 are respectively mounted on the peripheral edges of vanes 46.

The aforementioned gaps between wall segments 16 are closed by three triangularly-shaped shields 50 (see FIG. 4 wherein all of these shields are illustrated, and FIG. 3 wherein one of the shields is illustrated) each of which is secured at its opposite side edges to two of the confronting side edges of the wall segments by means of slats 52 anchored to the wall segments by bolts 54. Each shield consists of a sheet of flexible material formed with accordian-type pleats, so that when wall segments 16 are in the position illustrated in FIG. 1, the shields are compactly folded between the confronting side edges of the wall segments. The gaps between the radially extending edges of vanes 46 are likewise closed by three pleated connector panels 56 respectively secured to the vanes by means of slats 58 anchored by bolts 60.

Figure 5:
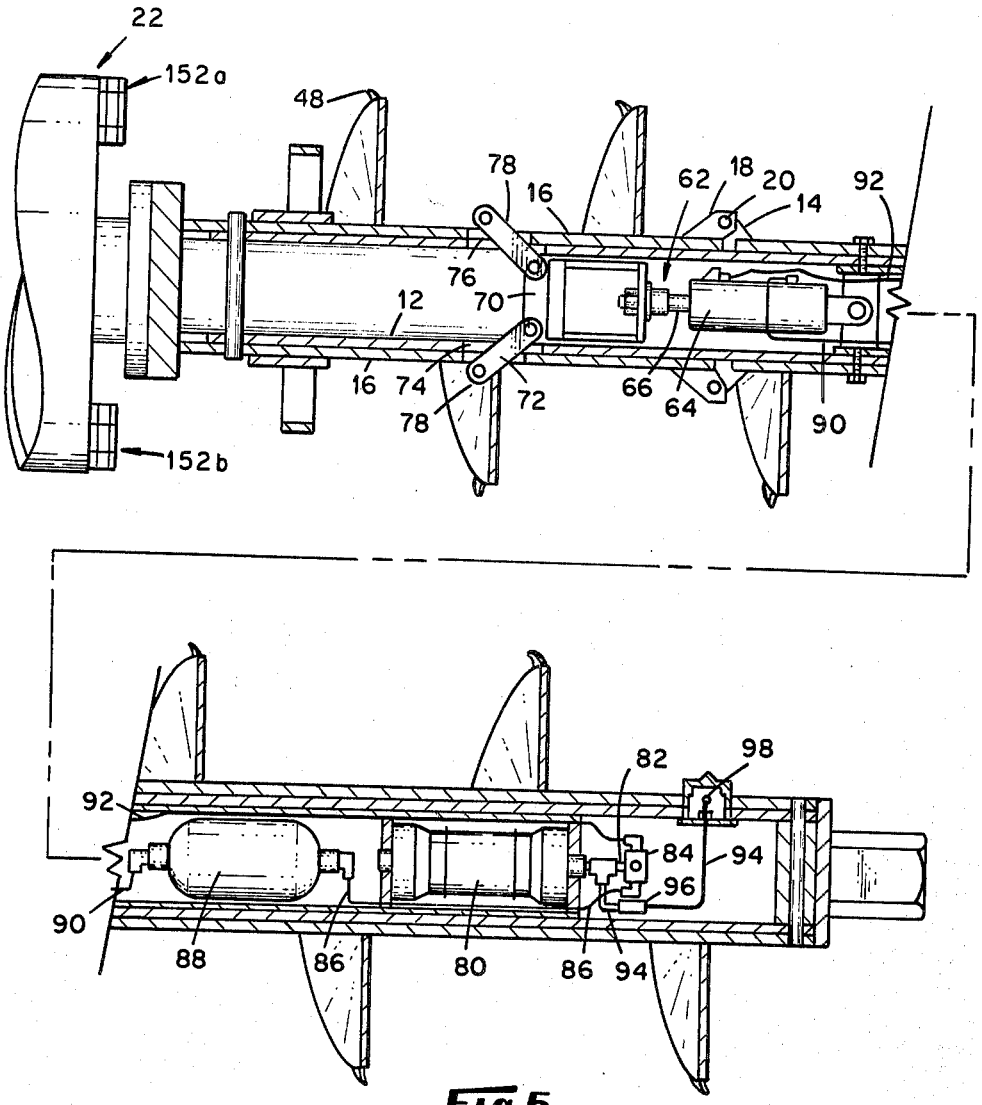
FIGS. 5 and 6 are longitudinal sectional views of the same embodiment, respectively illustrating the auger conveying and cutting segments in their retracted and deployed positions.
Figure 6:
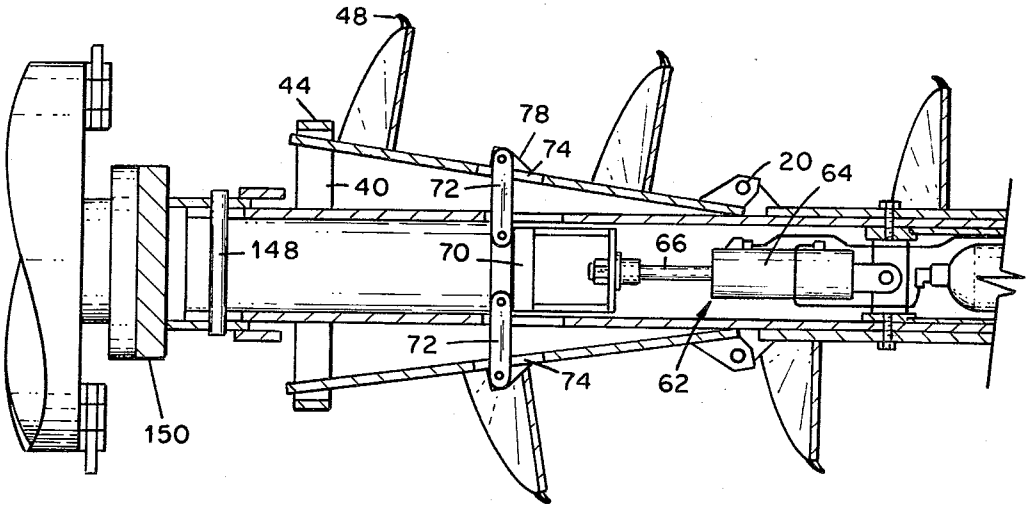

Generally designated in FIGS. 5 and 6 by reference number 62 is a fluid-operated ram comprising a cylinder 64 mounted inside shaft 12 and an actuator shaft 66. In the embodiment of the invention illustrated in these two drawings, actuator shaft 66 is connected at one end to a piston (not illustrated) slidably disposed within cylinder 64 and connected at its other end to a second piston 70 slidably disposed inside shaft 12. Three links 72 are each pivotally connected at one end thereof to piston 70 and respectively extend through slots 74 formed in shaft 12 and through slots 76 formed in wall segments 16, the outer ends of the links being respectively pivotally connected to lugs 78 attached to the outer surfaces of the wall segments. A container 80 for holding pressurized fluid is mounted behind cylinder 64 in shaft 12, and a conduit 82 connects this container with a valve 84. A second conduit 86 connects valve 84 with an accumulator container 88, and a third conduit 90 connects the latter with one end of cylinder 64. The opposite end of cyliinder 64 is connected with valve 84 by a fourth conduit 92, and a fifth conduit 94 extends from conduit 82 to a check valve 96 and thence to a charging fitting 98.

Figure 7:
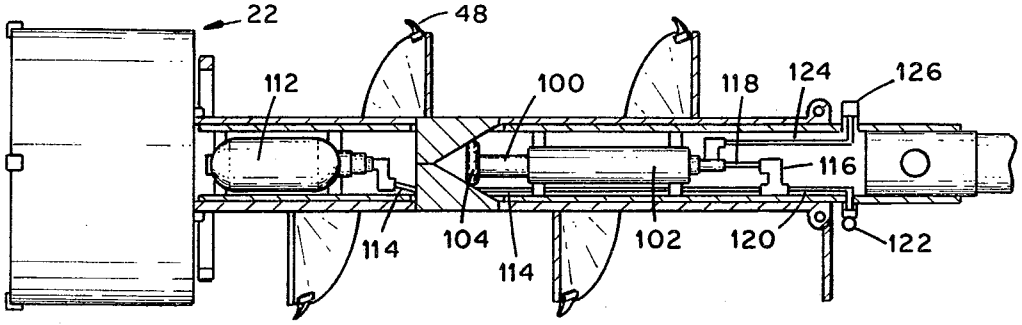
FIGS. 7 and 8 are longitudinal sectional views of a modification of the embodiment illustrated in FIGS. 1–6, respectively illustrating the auger conveying and cutting segments thereof in their retracted and deployed positions.
Figure 8:
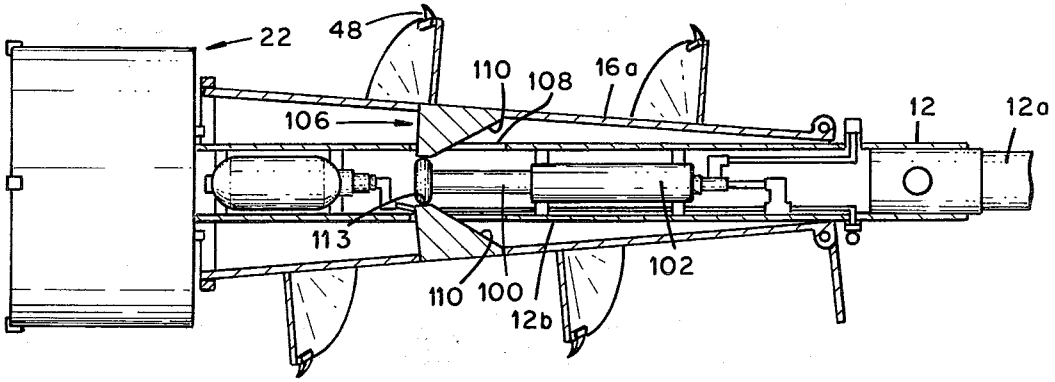

FIGS. 7 and 8 illustrate a modification of the actuation system described in the preceding paragraph. In this modification, the actuator shaft 100 of a fluid-operated ram cylinder 102 has at its free end a disk-shaped enlargement 104 having a rounded peripheral surface. A cam member, generally designated by reference number 106, is attached to each wall segment **16*a* and projects radially inward from the inner surface thereof through a slot 108 formed in the wall of shaft 12*b*. Each cam member includes a cam surface 110 disposed oblique to the longitudinal axis of shaft 12*b*, and a narrow end surface 113. A container 112 for holding pressurized fluid is mounted inside shaft 12*a*, and a conduit 114 connects this container with a valve 116 which in turn is connected to cylinder 102 by a second conduit 118. A third conduit 120 connects valve 116 to a charging fitting 122, and a fourth conduit 124 connects cylinder 102 to a bleed valve 126**.

Figure 9:
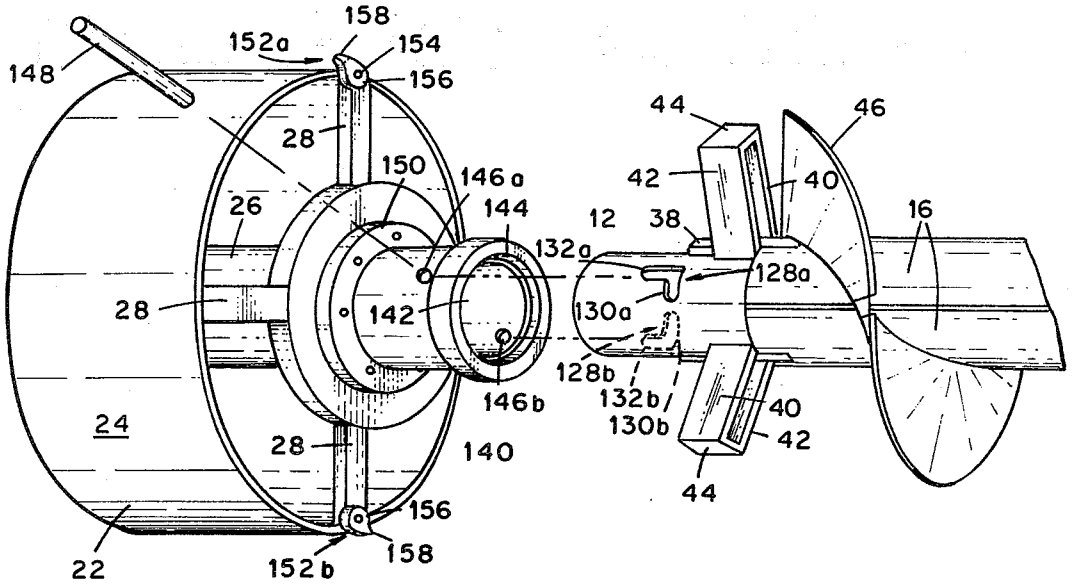
FIG. 9 is a detail view of components which mount a cutting head on the auger conveyer in the preferred embodiment of the invention, certain components being moved away from their assembled positions to reveal other structure that would otherwise be hidden.

FIG. 9 illustrates a preferred means for connecting cutting head 24 to shaft 12 (or to shaft **12*b* described in the preceding paragraph). Extending through the wall of shaft 12 adjacent the free end thereof are a pair of slots generally designated by reference number 128*a*, 128*b*. The slots are diametrically opposed to each other on the shaft, and each slot is formed with a first leg 130*a*, 130*b* extending circumferentially of the shaft and a second leg 132*a*, 132*b* extending longitudinally of the shaft. A sleeve generally designated by reference number 140 has a main bore 142 that slidably fits around the end of shaft 12 and a counterbore 144 that slidably fits around the forward ends of latch fingers 38 when the sleeve is in the position illustrated in FIG. 5. Diametrically opposed holes 146*a*, 146*b* are formed in sleeve 140, and a pin 148 is slidably fitted in slots 128*a*, 128*b* with its ends respectively fixed in these holes. Cutting head 22 is attached to a flange 150 integrally formed on the forward end of sleeve 140**.

Mounted at diametrically opposed points on cutting head 22 are two drag members generally designated by reference numbers **152*a*, 152*b*. Each drag member 152*a*, 152*b* is pivotally mounted on a pivot pin 154 mounted on and projecting rearwardly from one of the arms 28 of cutting head 22. Each drag member includes a generally disk-shaped central portion 156 and a tooth 158 projecting from the latter. A conventional wire spring (not illustrated) is disposed around each pin 154 and connected with the drag member carried by the pin so as to bias it to a position wherein its tooth 15 projects from the outer ring 24 of cutting head 22 as illustrated in FIG. 9**.

OPERATION OF THE PREFERRED EMBODIMENTS OF THE INVENTION

The disclosed cutting assembly 10 is used to mine a material such as coal by advancing cutting head 22 into the material from a vertical mining face, this movement being effected while wall segments 16 are in their first retracted position illustrated in FIG. 1. As noted hereinbefore, additional auger conveyer segments can be tandemly connected to support shaft 12 to increase the depth of the hole drilled by the assembly. As material is cut by cutting head 22 it is conveyed out of the hole by the helical wall formed by vanes 46 and by any auger conveyer segments joined with shaft 12. While cutting head 22 is being advanced, the actuator shaft 66, 100 of the wall segment deploying arrangement is retracted into its ram cylinder as illustrated in either FIG. 5 or 7. During this phase of the cutting operation, shaft 12 is being rotated in a counterclockwise direction as viewed in FIG. 2 and pin 148 is located in the first legs **130*a*, 130*b* of the slots 128*a*, 128*b* in shaft 12. More particularly, pin 148 abuts the end wall portion of leg 130*a*, 130*b* of each slot and is spaced from the second leg portion 132*a*, 132*b* of each slot. This location of pin 148 places the rear end of sleeve 140 over the forward ends of latch fingers 38, thus holding wall segments 16 and the vanes 46 thereon in their retracted position. As cutting head 22 is being advanced each drag member 152*a*, 152*b* is held in a position wherein its tooth 158 is inside the perimeter of ring 24** of the cutting head, since the rotation of the cutting head is such that the drag members slide on the wall of the drilled hole and are held by said wall in a retracted position.

Figure 2:
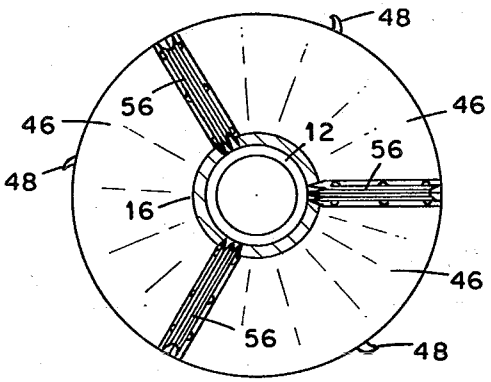
FIG. 2 is a cross-sectional view of the same embodiment, taken along the plane represented by line 2—2 in FIG. 1 and in the direction indicated by arrows in the latter drawing.

When the drilled hole has reached its desired depth, shaft 12 is rotated a short angular distance in the clockwise direction as viewed in FIG. 2. When the direction of rotation of shaft 12 is reversed, pin 148 is moved away from its abutment with the end wall of leg **130*a***, 130*b* of each slot 128*a*, 128*b* to a position wherein the pin is aligned with the leg portion 132*a*, 132*b* of each slot. Continued rotation of shaft 12 in the reverse direction causes cutting head 22 to move counterclockwise as viewed in FIG. 9, and the tooth 158 on each drag member 152*a*, 152*b* digs into the wall of the drilled hole. Rotation of shaft 12 in the reverse direction is then stopped, and the shaft is moved in the direction which draws it out of the drilled hole, whereupon pin 148 is moved longitudinally of each leg 132*a*, 132*b* of slots 128*a*, 128*b* until it contacts the end thereof. During this movement latch fingers 38 are withdrawn from the counterbore 144 in sleeve 140. Wall segments 46 are now deployed by operating the ram cylinder 64 or 102, depending upon the particular actuation system employed with the cutting assembly. If the system illustrated in FIGS. 5 and 6 is used, valve 84 is opened to allow fluid to flow from container 80 and accumulator 88 to cylinder 64, thereby moving actuator shaft 66 to the position illustrated in FIG. 6 and pivoting links 72 to the position which moves the free ends of wall segments 16 to a position spaced radially outward from shaft 12. It should be noted that links 72 are disposed perpendicular to the longitudinal axis of shaft 12 when wall segments 16 are deployed, resulting in a self-locking arrangement (i.e., forces exerted on the wall segments are not transmitted to cylinder 64). Furthermore, when wall segments 16 are deployed vanes 46 project radially beyond the perimeter of ring 24 of cutting head 22. As wall segments 16 are being deployed, shaft 12 is rotated in a counter-clockwise direction as viewed in FIG. 2 while simultaneously beind moved in the direction which retracts it from the drilled hole. During this movement cutters 48 on vanes 46 enlarge the diameter of the hole cut by cutting head 22. It will be apparent that if the wall segment deployment system illustrated in FIGS. 7 and 8 is used, actuator shaft 100 is moved toward cutting head 22 by opening valve 116, whereby the enlargement 104 on the actuator shaft pushes cam members 106 and the wall segments 16*a* attached thereto to the position illustrated in FIG. 8. When wall segments 16*a* are fully deployed, the peripheral edge of the enlargement 104 on shaft 100 abuts the end surfaces 113 of cam members 106 which extend longitudinally of shaft 12.

As cutters 48 enlarge the hole cut by cutting head 22, the cut material is moved toward the outer end of the hole by the helical wall, or flight, formed by vanes 46 and connector panels 56 around the tube-shaped shell formed by wall segments 16 (or 16*a*) and shields 50. At any selected time during the retraction of cutting assembly 10 from the hole which has been drilled, wall segments 16 can be returned to their initial position adjacent shaft 12 by operating either cylinder 64 or 102, depending on the deployment system used in the cutting assembly, to move the actuator shaft 66 or 100 associated therewith away from cutting head 22. When wall segments 16 move toward shaft 12, the pleated shields 50 and connector panels 56 fold into the compact configuration illustrated in FIGS. 1 and 2.

It will be recognized that the placement of the pressurized fluid container 80 or 112 within tubular shaft 12 eliminates the long fluid supply conduits that would be required if a pressure source located outside the hole drilled by the assembly were used to operate cylinder 64 or 102. With the disclosed actuation system, actuator shafts 66 and 100 can readily be moved in opposite directions by operating the valves associated therewith. Either container 80 or 112 can also readily be pressurized by connecting a source of pressurized fluid to either fitting 98 or 122 when the cutting assembly is outside a hole.

Since wall segments 16 can be deployed or retracted at any selected point in the hole cut by cutting head 22, it is possible by use of the disclosed cutting assembly 10 to drill a plurality of horizontally extending holes in a vertical mine facing and to vary the diameter of these holes at points spaced apart longitudinally thereof. Hence, the web thickness between adjacent holes can be varied to provide at a selected location a section of material where the holes have a reduced diameter, which section will serve as a support wall preventing collapse of the drilled material. Yet by use of the disclosed cutting assembly, the webs between the plurality of drilled holes at points behind such a support wall can be made thin so as to recover a high percentage of mined material, but the backreamer is retracted near the face to preserve highwall integrity. For this operation, the lead auger flighting can be arranged to allow mechanically initiated retraction crew members outside the hole or by automatic actuation. Retraction of the head assembly could be accomplished by using a telemetric system and appropriate electrical controls at the head assembly.

Figure 3:
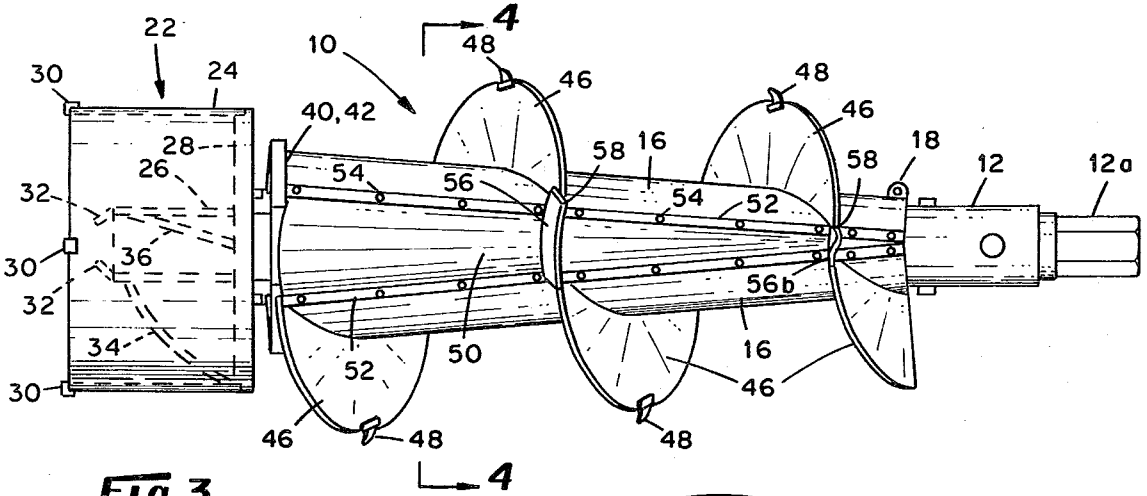
FIG. 3 is a side elevation of the same embodiment of the invention, illustrating the auger conveying and cutting segments in an outwardly deployed position.
Figure 4:
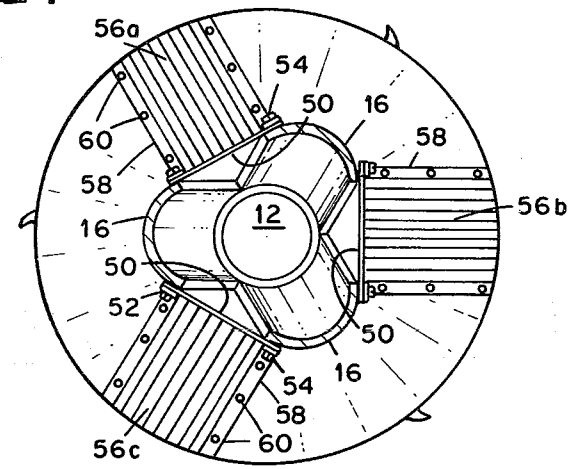
FIG. 4 is a cross-sectional view of the same embodiment, taken along the plane represented by line 4—4 in FIG. 3 and in the direction indicated by arrows in the latter drawing.

Various modifications can be made in the disclosed apparatus without departing from the concepts of the invention. For example, the folding shields 50 and connector panels 56 can be replaced by sheets which respectively telescope into slots formed in the side edges of wall segments 16 and the radially extending edges of vanes 46. Since advance retract and rotational motions are present, it would be possible to operate the expandable flight sections by means of a totally mechanical automatically operated system. Such a system may consist of a jack-screw, or similar device, powered by auger rotation and actuated by a sequence retract and/or auger rotation. A suitable system of this type is illustrated in schematic form in FIG. 10, wherein components identical to those included in the embodiment of the invention illustrated in FIGS. 1–3 are designated by the same reference numbers used therein.

Figure 10:
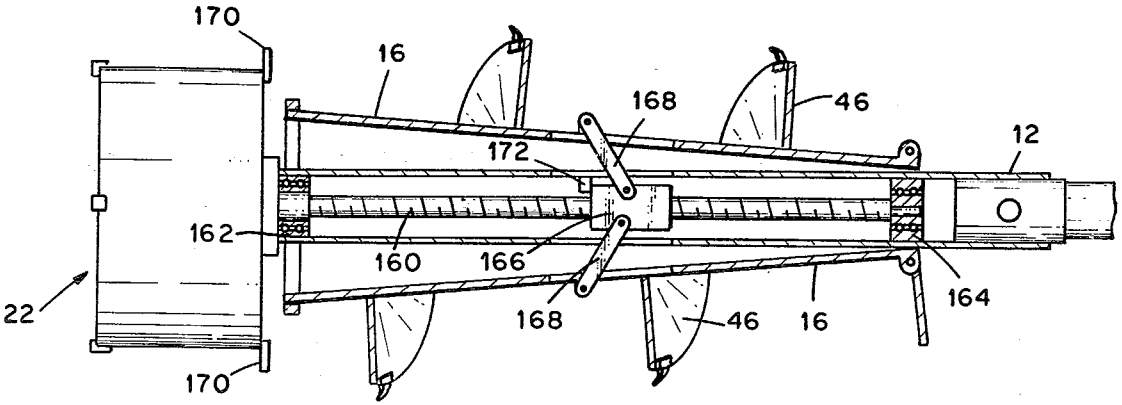
FIG. 10 is a longitudinal sectional view of another embodiment of the invention.

In the FIG. 10 embodiment of the invention, cutter head 22 is fixedly mounted on the forward end of a jack-screw 160 that is itself rotatably mounted in bearings 162, 164 secured to the inner wall of shaft 12. A hub 166 is threadedly engaged with jack-screw 160, and links 168 are pivotally connected to this hub and to expandable wall segments 16 carrying auger vanes 46. When shaft 12 is rotated during the advancement of cutter head 22 into material, lugs 170 mounted on the cutter head are retracted to a position wherein they do not protrude beyond the perimeter of the cutter head. At this time, hub 166 abuts the housing of rear bearing 164, and wall segments 16 are retracted so that they form a cylindrical shell around shaft 12. Since hub 166 abuts the housing of bearing 164 cutter head 22 rotates with shaft 12. However, when the directions of rotation of shaft 12 is reversed, lugs 170 move radially outwardly from the perimeter of cutter head 22 and prevent rotation of the cutter head with the shaft by biting into the wall of the bore hole cut by the cutter head. As shaft 12 continues to rotate, hub 166 moves forwardly on jack-screw 160 and wall segments 16 are thus moved to the position illustrated in FIG. 10. In the deployed position of wall segments 16, hub 166 abuts a stop 172 fixed to the inner wall of shaft 12. Thereafter, cutter head rotates with shaft 12 as vanes 46 enlarge the bore hole. Other automatic arrangements for opening wall segments 16 can also be employed.

What is claimed is:

1. A cutting assembly comprising:

a support shaft;

a cutting head carried at one end of said shaft;

a plurality of wall segments pivotally connected at one end thereof to said support shaft at points spaced equidistant from said cutting head and each extending from its point of connection with said support shaft to a point adjacent said cutting head, said wall segments being disposed around said support shaft in side by side relation and each being curved to conform with the periphery thereof, said wall segments being swingable between (1) a first position wherein they lie adjacent said support shaft, and (2) a second position wherein their free ends are spaced radially outward from said support shaft;

a plurality of shields respectively extending between and connected to confronting side edges of said wall segments, said shields and said wall segments together forming a continuous wall around said support shaft;

a plurality of vanes respectively mounted on the outer surfaces of said wall segments and projecting radially outward therefrom, said vanes together forming a substantially continuous helical wall extending around the tube-shaped shell formed by said wall segments when the latter are in said first position thereof, said vanes projecting radially outward beyond the outer perimeter of said cutting head when said wall segments are in said second position thereof;

a plurality of cutters respectively mounted on the outer edges of said vanes; and means for moving said wall segments between said first and second positions thereof.

2. The assembly of claim 1 wherein said shields are formed with accordian-type pleats and fold when said wall segments are moved from said second position to said first position.

3. The assembly of claim 1 including a plurality of connector panels respectively extending between and connected to confronting side edges of said vanes, said connected panels and said vanes together forming a continuous helical wall.

4. The assembly of claim 3 wherein said connector panels are formed with accordian-type pleats and fold when said wall segments are moved from said second position to said first position.

5. The assembly of claim 1 wherein said support shaft is tubular and has a pair of diametrically opposed slots extending through the wall thereof, each of said slots including a first leg extending circumferentially of said support shaft and a second leg extending longitudinally of said support shaft between said first leg and said cutting head, said assembly further including (1) latch fingers respectively projecting from the free ends of said wall segments toward said cutting head, (2) a sleeve slidably mounted on said support shaft and overlying said slots, said cutting head being attached to the end of said sleeve remote from said wall segments, the end of said sleeve proximal to said wall segments having a counterbore therein, the free ends of said latch fingers being disposed in said counterbore while said cutting head is being advanced into the material to be cut, (3) a pin fixedly attached at its end to said sleeve and extending through said slots, and (4) at least one drag member mounted on said cutting head for movement between a first position wherein it is disposed inside the perimeter of said cutting head and a second position wherein it projects radially outward from the perimeter of said cutting head.

6. The assembly of claim 5 including a plurality of guide fingers fixedly attached to and projecting radially outward from said support shaft, said latch fingers being respectively slidably disposed between associated pairs of said guide fingers.

* * * * *